United States Patent [19]

Peyre et al.

[11] Patent Number: 4,630,542

[45] Date of Patent: Dec. 23, 1986

[54] NACELLE

[75] Inventors: Xavier M. Peyre, Ruvere; Jean-Pierre Manesse, Basse Goulaine, both of France

[73] Assignee: Alsthom-Atlantique and Plastibenne, France

[21] Appl. No.: 605,029

[22] PCT Filed: Sep. 7, 1983

[86] PCT No.: PCT/FR83/00176

§ 371 Date: Apr. 25, 1984

§ 102(e) Date: Apr. 25, 1984

[30] Foreign Application Priority Data

Sep. 7, 1982 [FR] France ..... 82 15164

[51] Int. Cl.[4] ..... B63B 27/30

[52] U.S. Cl. ..... 104/114; 104/112; 212/147; 212/191; 254/277; 254/900; 414/137; 414/139

[58] Field of Search ..... 414/139, 137; 212/147, 212/191; 254/277 X, 900 X; 104/112, 114, 117; 187/6

[56] References Cited

U.S. PATENT DOCUMENTS

| | | | |
|---|---|---|---|
| 3,648,858 | 3/1972 | Barron et al. | 254/900 X |
| 4,018,306 | 4/1977 | Lyons | 187/6 |
| 4,173,804 | 11/1979 | Duc | 254/277 X |

FOREIGN PATENT DOCUMENTS

| | | |
|---|---|---|
| 0864814 | 7/1978 | Bulgaria . |
| 0053770 | 6/1982 | European Pat. Off. . |
| 2493290 | 5/1982 | France . |
| WO81/01402 | 5/1981 | PCT Int'l Appl. . |

*Primary Examiner*—Robert J. Spar
*Assistant Examiner*—Janice Krizek
*Attorney, Agent, or Firm*—Sughrue, Mion, Zinn, Macpeak, and Seas

[57] ABSTRACT

The nacelle (3) is characterized in that it includes at least one cable (6) having a top end that leaves the nacelle upwardly and a bottom end that leaves the nacelle downwardly, and a mechanism (11) enabling the nacelle to move up and down the cable when the top end of the cable is hooked to a hook unit (4). A mechanism enables the top portion of the cable to be subjected to a tension greater than the weight of the nacelle while the bottom portion (7) of the cable is fixed to an anchor point, said tensioning mechanism serving to vary the distance between the nacelle (3) and said hook unit at the top end of the cable. Further, mechanism (12, 14) acts on command, on said tensioning mechanism in such a manner as to prevent the distance between the nacelle (3) and the hook unit (4) at the top end of the cable from shortening while not preventing it from lengthening.

5 Claims, 4 Drawing Figures

NACELLE

FIELD OF THE INVENTION

The prevent invention relates to a nacelle which in a first application enables a load and in particular personnel to be transferred between a fixed or moving structure and a structure which is subject to heaving movements, and which in a second application may be used as a stably-suspended diving bell.

BACKGROUND OF THE INVENTION

The invention is particularly applicable in the oil industry for transferring personnel from an off-shore platform to a boat and vice versa.

The problem arises because these platforms are sometimes located far out to sea where the operation of transferring personnel is made dangerous by the swell.

French patent application No. 2493 290 describes a device for transporting personnel by means of a crane between a first support on which the crane is disposed and a second support situated at a lower level than the first support and subject to relative movement relative to the first support. This device includes a nacelle having two separate winches enabling one of them to unwind a cable upwardly while the other unwinds a cable downwardly.

The two winches are driven by a single constant couple motor via a differential planetary reduction gear. A ratchet system enables rotation in one direction on one or other of the winches to be blocked on command. When the ratchet on one of the winches is not in the blocking position, the corresponding winch can rotate in both directions which enables it to wind in and out in time with the swell.

When the load is suspended in the air, the ratchets on the upper winch bear the entire load (the nacelle).

Although this system is satisfactory, it suffers from certain drawbacks. It is rather complicated to control and requires the crane operator to perform actions to which he is not accustomed. It includes a feed cable which is connected to the crane and which connects the nacelle to the crane. The ratchet system requires safety devices. Finally, although a load can be lifted automatically and without shocks from a boat by means of the heaving compensation device, the same is not true when a load is lowered onto the deck of a boat in which case the softness of the landing depends on the skill of the crane driver in allowing for the swell. In fact, the lowering system does not compensate for heaving but only ensures lateral guidance of the nacelle, which in itself is a most important function.

Belgian Pat. No. 864 814 describes a device for stably suspending a load beneath a boat, however in this device said boat necessarily includes special arrangements which firmly link the boat to said load and which prevents the load, for example a diving bell, from being suspended from any boat.

SUMMARY OF THE INVENTION

The aim of the present invention is to mitigate these drawbacks, and it provides a Nacelle characterised in that it includes at least one cable having a top end that leaves the nacelle upwardly and a bottom end that leaves the nacelle downwardly, means enabling the nacelle to move up and down the cable when the top end of the cable is hooked to a hook unit, means enabling the top portion of the cable to be subjected to a tension greater than the weight of the nacelle while the bottom portion of the cable is fixed to an anchor point, said tensioning means serving to vary the distance between the nacelle and said hook unit at the top end of the cable, and means acting, on command, on said tensioning means in such a manner as to prevent the distance between the nacelle and the hook unit at the top end of the cable from shortening while permitting it to lengthen.

Advantageously, said means enabling the top portion of the cable to be subjected to a tension greater than the weight of the cabin and enabling the distance between the nacelle and the hook unit to be varied, and the means acting, on command, to prevent said distance from shortening, comprise a hydraulic jack having a pulley at each end over which said cable is reeved, the jack being connected to a compressed gas accumulator having a free piston via a conduit including a cock enabling said conduit to be opened or closed, said conduit being provided with a parallel conduit including a non-return valve preventing return from the accumulator towards the jack.

The invention is applicable in particular to transferring a load between a fixed or moving structure and a structure which is subjected to heaving movements, characterised in that the bottom end of the cable is hooked via a rapid-release hook at the intended landing site on the structure subjected to heaving movements, the top end of the cable being hooked to the hook of a crane situated on the fixed or moving structure.

The invention is also applicable to a stably-suspended diving bell, with the bottom portion of the cable being hooked to the sea bottom and the top portion of the cable being hooked to a heaving assembly.

Other advantages and characteristics of the invention appear from the following description of a preferred embodiment of the invention given with reference to the accompanying drawings.

DESCRIPTION OF THE PREFERRED EMBODIMENT

Figure 1:
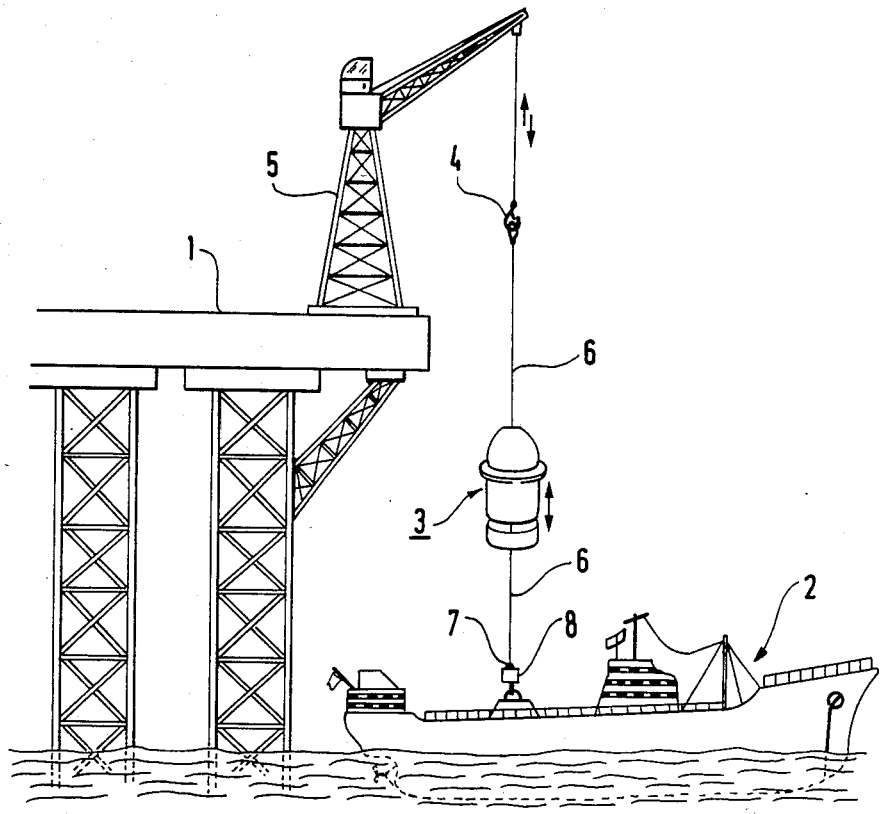
FIG. 1 is a general elevational view showing the transfer of a load from a boat to a platform or vice versa, the load in the example comprises personnel.

With reference to FIG. 1, there can be seen a platform 1 and a boat 2 for transporting personnel from the coast to the platform. Transfer from the boat 2 towards the platform 1 or vice versa is performed by means of a nacelle 3 which is suspended from a hook 4 of a crane 5 situated on the platform.

The principle of the invention consists in making the nacelle move, depending on the direction of transfer, up or down a cable 6 by means of a motor situated in the nacelle, the top end of the cable being hooked to the hook 4 of the crane 5 and the bottom end 7 of the cable being hooked by means of a rapid-release hook 8 on the deck of the boat 2. The nacelle 3 includes means, described below with reference to FIG. 3, enabling the nacelle to follow the movements of the swell when the hook 8 is hooked to the deck of the boat, and enabling the nacelle to be disconnected from the movement of the boat by releasing the hook 8 when the cable between the nacelle and the deck of the boat is slack.

Such a principle may be illustrated by means of a cabin which grips a cable passing therethrough, the cabin including means for rising along the cable, the bottom end of the cable being hooked to the deck of a boat via a rapid-release hook means and the top end of the cable passing over a pulley suspended from the hook of a crane and including a counterweight which is heavier than the cabin, means being provided for controllably stopping the descent of the counterweight a few instants before the cable is unhooked from the deck of the boat during some phase of the boat on the swell.

Figure 3:
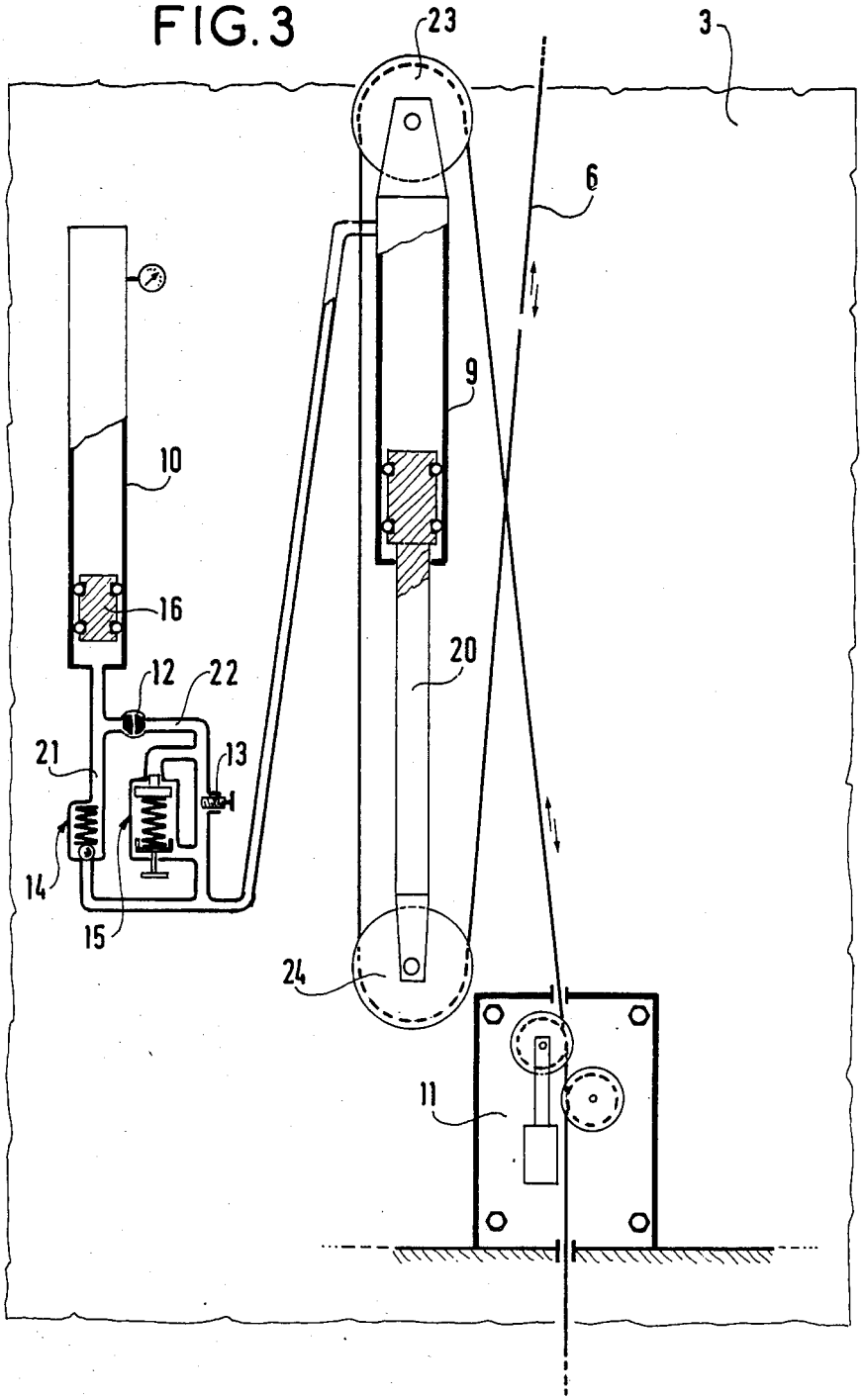
FIG. 3 is a schematic view, partially in section which shows the mechanism situated in the nacelle.

FIG. 3 shows a particular preferred mechanism enabling the same result to be obtained but in which the counterweight is replaced by a more realistic hydropneumatic system.

Everything shown in this figure is situated inside the nacelle 3.

The cable 6 is reeved over pulleys 23, 24 of a hydraulic jack 9 which is fitted at each of its ends with pulleys 23, 24 and which is connected to a compressed gas accumulator 10. The cable passes through an endless cable winch 11. Naturally, the winch cannot be caused to move under the sole action of the cable and the cable cannot slip relative to the winch.

Furthermore, the winch is naturally situated between the bottom end 7 of the cable 6 and the jack 9.

The hydraulic circuit includes a quarter-turn cock 12 and a flow-rate regulating cock 13 in series therewith. These two cocks are connected in parallel with a non-return valve 14 which prevents oil from passing from the accumulator towards the jack, and in parallel with the flow-rate cock 13 there is a safety valve 15. The accumulator 10 includes a free piston 16 which separates the compressed gas contained in the accumulator above the piston 16 from the oil which fills the jack and the hydraulic circuit described above.

Figure 2:
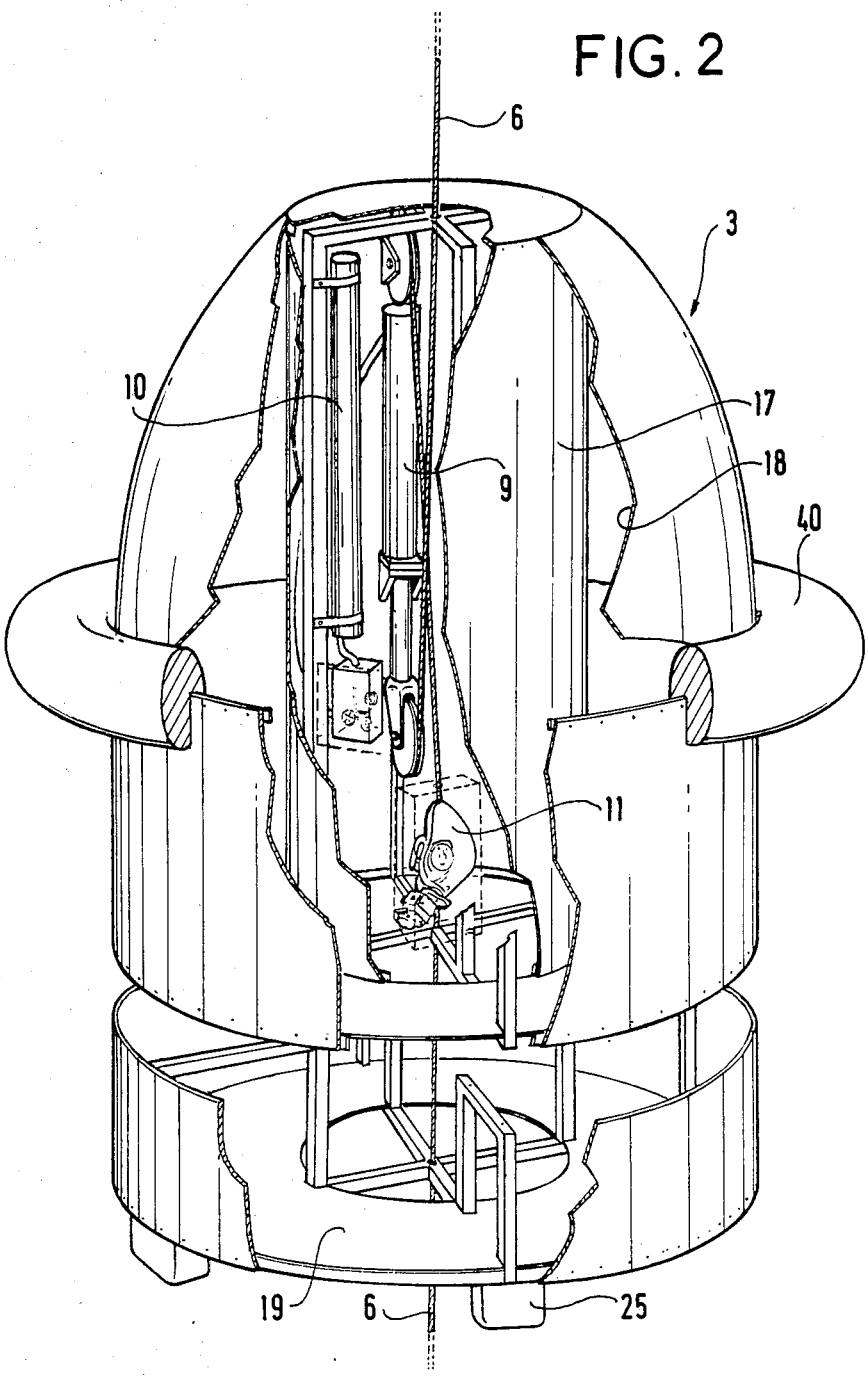
FIG. 2 is a partially cut-away perspective view of a transfer nacelle in accordance with the invention.

FIG. 2 is a partially cut-away perspective view of a nacelle containing all the items shown in FIG. 3. These items are housed in the central portion of the nacelle inside a cylinder 17 which encloses the mechanism.

The passengers are located in between the cylinder 17 and the outside wall 18 of the nacelle. A baggage compartment 19 is situated at the bottom of the nacelle. Shock absorbers 25 are provided underneath the bottom of the nacelle. Finally, a circular float 40 is fixed around the nacelle to ensure that it floats in the event of an accident.

The device operates as follows:

First case: transferring passengers from the boat 2 to the platform 1.

The nacelle 3 stands on the deck of the boat, the bottom end 7 of the cable 6 is hooked, underneath the nacelle, via the rapid-release hook 8 to the deck of the boat and it is under tension. The rapid-release hook may release automatically when tension is no longer applied, and it may be connected to the cable 6 by shock-absorbing means.

The boat locates itself substantially underneath the crane hooks. The crew hook the hook 4 of the crane 5 to the top end of the cable 6 where it leaves the top of the nacelle. The valve 12 is opened, i.e. turned through 90° from the position shown in FIG. 3. The rod 20 in the jack 9 projects out therefrom, and the piston 16 in the accumulator 10 is at the bottom thereof. The crane driver then raises the hook 4 of his crane so as to put the cable 6 under tension.

The passengers then mount into the nacelle and put the winch 11 into operation. The nacelle then climbs along the cable 6, adding its upwards movement to the heaving movement of the boat, with the rod 20 of the jack moving in and out in time with the waves. The rod moves in under the traction force of the portion of the cable situated beneath the nacelle and hooked to the deck of the boat during troughs in the waves, and it moves out under the action of the gas pressure in the accumulator 10 as the waves rise.

Once the nacelle has moved some way along the cable, e.g. about 10 meters, which distance is simply the maximum peak-to-peak distance of the boat's heaving, the cock 12 is closed at any point in the cycle which can be easily performed automatically, e.g. by a cam. Under these conditions, during a period when the boat is rising on the swell, that portion of the cable 6 which is situated between the boat and the nacelle goes slack since the rod 20 of the jack no longer moves out under the action of the pressure in the accumulator 10 since the conduit 21 includes a non-return valve 14 and the conduit 22 is closed by the cock 12. The crew then release the hook 8 and the crane driver can bring the cabin onto the platform 1.

Second case: Transferring passengers from the platform 1 to the boat 2.

The passengers enter the nacelle while the cock 12 is closed and the rod 20 of the jack is already partially into the cylinder. The crane driver lowers the cabin to a point about 20 meters above the boat. The crew then hook the hook 8 onto the deck of the boat. The cock 12 is then opened, and under the pressure in the accumulator 10, the rod 20 of the jack 9 moves out therefrom, thereby raising the nacelle and thus tensioning the lower portion of the cable 6 situated underneath the nacelle. From this moment, the nacelle moves with the movement of the boat and the winch 11 is set in motion to cause the nacelle to move down the cable 6.

Once the nacelle has arrived on deck, the passengers alight and the crane hook is unhooked from the cable 6.

The flow-rate regulating cock 13 serves to attenuate the speed at which the nacelle 3 rises when the cock 12 is opened by limiting the oil flow rate. The flow-rate limiting cock 13 is bypassed by a safety valve 15.

The winch 11 may be driven by a heat engine, an electric motor, or by any other system.

Electric current may be supplied via a cable from the boat. This cable is connected and disconnected at the same time as the cable 6 by means of the hook 8. Current could also be provided by a storage battery located in the baggage compartment. The winch may, for example, be the winch sold under the name LIFTO by the company LAHO, and the hook 8 may, for example, be a navy-type remote rapid-release hook.

In practice, there may be plurality of jacks, e.g. two, each of which is coupled to an accumulator of adequate capacity.

The following numerical example may be given in non-limiting manner:

weight of the cabin with passengers: 1700 kg,
two 10 cm diameter jacks having a stroke of 1.5 m,
cable 50 m long and 12 mm in diameter,
30 cm diameter pulleys,
cable tension below the cabin during the period in which the cable is hooked to the deck: 2500 kg, pressure in the accumulators when empty: 64 bars, maximum pressure in the hydraulic circuit: 180 bars, a MOTRIX 1500 lift motor from the company LAHO, volume of oil: 24 liters.

The system in accordance with the invention has numerous advantages: the nacelle lands on and lifts off from the boat gently; the nacelle then passes, still gently, from being attached to a first moving structure to being attached to a second moving structure which may be fixed or moving; the crew, the crane driver and the passengers only have to perform simple operations with which they are already thoroughly familiar.

The device can be used from any structure fitted with an adequate crane and from any side of the structure. Naturally, the stroke of the jacks is calculated so as to be greater than the sum of the maximum displacement expected between the two structures.

Figure 4:
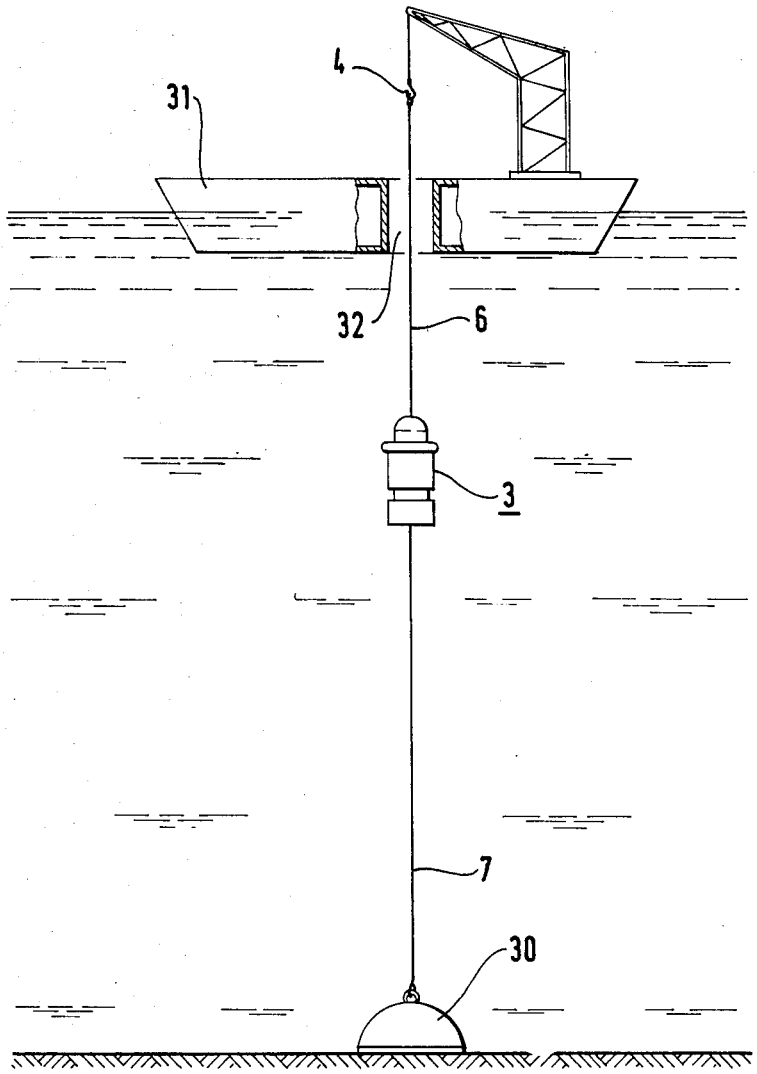
FIG. 4 is an elevational view which shows an application of nacelle in accordance with the invention to a stably-suspended sea diving bell.

As mentioned above, a nacelle in accordance with the invention may also be used as a diving bell for providing stable suspension as shown in FIG. 4. The end 7 of the cable 6 is fixed to the bottom of the sea by an anchor 30 and the hook 4 is connected to a heaving assembly such as a ship 31. The nacelle may rise into a well 32 in the ship. The bottom end 7 of the cable 6 may then be detached from the anchor 30.

We claim:

1. An autonomous nacelle for moving up and down a cable between first and second vertically spaced structures, one of said structures being a vertically heaving structure, one of said structures having an anchor point, and the other of said structures having a hook unit, said nacelle receiving said cable (6) with said cable passing through said nacelle and having a top end that leaves the nacelle upwardly and a bottom end that leaves the nacelle downwardly, said nacelle comprising:

means (11) within said nacelle for gripping said cable as it passes through said nacelle for driving the nacelle to move it up and down the cable when the top end of the cable is hooked to said hook unit (4), tensioning means (9, 10) within said nacelle and engaging said cable passing through said nacelle for enabling the top portion of the cable to be subjected to a tension greater than the weight of the nacelle while the bottom portion (7) of the cable is fixed to said anchor point, said tensioning means serving to vary the distance between the nacelle (3) and said hook unit at the top end of the cable, and means (12, 14) within said nacelle for acting, on command, on said tensioning means so as to prevent the distance between the nacelle (3) and the hook unit (4) at the top end of the cable from shortening while permitting it to lengthen.

2. A nacelle according to claim 1, wherein said means enabling the top portion of the cable to be subjected to a tension greater than the weight of the nacelle and enabling the distance between the nacelle and the hook unit to be varied, and the means acting, on command, to prevent said distance from shortening, comprise a hydraulic jack (9) having a pulley (23, 24) at each end over which said cable (6) is reeved, a compressed gas accumulator (10) connected to the jack, said compressed gas accumulator (10) having a free piston (16) and being connected to said jack via a conduit (22) including a cock (12) enabling said conduit to be opened or closed, and said conduit being provided with a parallel conduit (21) including a non-return valve (14) for preventing hydraulic fluid return from the accumulator (10) towards the jack.

3. A nacelle according to claim 1, wherein the means enabling the nacelle to move up and down the cable (6) comprises an endless cable winch (11).

4. A nacelle according to claim 1, wherein a load is transferred between a fixed or moving structure (1) and a structure (2) which is subjected to heaving movements, and wherein the bottom end (7) of the cable is hooked via a rapid-release hook (8) at the intended underlying landing site on the structure (2) subjected to heaving movements, and the top end of the cable (6) being hooked to the hook (4) of a crane (5) situated on the fixed or moving structure (1).

5. A nacelle according to claim 1, used as a stably-suspended diving bell, wherein the bottom portion (7) of the cable (6) is hooked to the sea bottom and the top portion of the cable (6) is hooked to said heaving structure.

* * * * *